US006425980B1

(12) United States Patent
Mirsberger et al.

(10) Patent No.: US 6,425,980 B1
(45) Date of Patent: Jul. 30, 2002

(54) PRESS DEVICE AND PROCESS FOR TREATING A MATERIAL WEB

(75) Inventors: Peter Mirsberger, Baienfurt; Hans Dahl, Ravensburg; Andreas Meschenmoser, Horgenzell, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/291,479

(22) Filed: Apr. 14, 1999

(30) Foreign Application Priority Data

| | | |
|---|---|---|
| Apr. 15, 1998 | (DE) | 198 16 673 |
| Jun. 19, 1998 | (DE) | 298 11 048 |
| Oct. 20, 1998 | (DE) | 198 48 284 |

(51) Int. Cl.[7] ..... D21F 3/04
(52) U.S. Cl. ..... 162/205; 162/358.3; 162/360.2
(58) Field of Search ..... 162/358.3, 360.2, 162/360.3, 205

(56) References Cited

U.S. PATENT DOCUMENTS

| | | | | |
|---|---|---|---|---|
| 2,618,205 A | * | 11/1952 | Heys | 162/360.3 |
| 2,748,671 A | | 6/1956 | Heys | |
| 4,173,249 A | * | 11/1979 | Holkko et al. | 162/360.3 |
| 4,586,984 A | * | 5/1986 | Laapotti | 162/358.3 |
| 4,648,942 A | * | 3/1987 | Wanke et al. | 162/286 |
| 4,915,790 A | * | 4/1990 | Dahl | 162/358.3 |
| 4,988,410 A | | 1/1991 | Meinecke et al. | 162/360.1 |
| 5,308,450 A | | 5/1994 | Braun et al. | 162/360.2 |
| 5,389,205 A | * | 2/1995 | Pajula et al. | 162/358.3 |
| 5,439,559 A | | 8/1995 | Crouse | |
| 5,833,810 A | | 11/1998 | Laapotti | |
| 5,865,954 A | * | 2/1999 | Laapotti | 162/358.3 |
| 5,868,904 A | | 2/1999 | Laapotti | |
| 6,090,244 A | * | 7/2000 | Kotitschke | 162/360.2 |

FOREIGN PATENT DOCUMENTS

| | | |
|---|---|---|
| DE | 8805966 | 10/1989 |
| DE | 9011940 | 10/1991 |
| DE | 4023297 | 1/1992 |
| DE | 9206340 | 9/1992 |
| DE | 4227000 | 12/1992 |
| DE | 29621078 | 3/1997 |
| DE | 19756203 | 9/1998 |
| DE | 29823556 | 10/1999 |
| EP | 657579 | 6/1995 |
| EP | 0803605 | 10/1997 |

* cited by examiner

*Primary Examiner*—Karen M. Hastings
(74) *Attorney, Agent, or Firm*—Greenblum & Bernstein, P.L.C.

(57) ABSTRACT

Press device and process for treating a material web. The press device includes a first shoe press and a second shoe press. The first and the second shoe press are successively arranged in a web run direction. A transfer suction roll is positioned between the first shoe press and the second shoe press and is adapted to at least partially suction the material web and to guide the material web in a closed draw through at least one of the first and the second shoe presses. The process may includes at least partially suctioning the material web with the transfer suction roll, and guiding the material web in a closed draw through at least one of the first and the second shoe presses.

36 Claims, 3 Drawing Sheets

PRESS DEVICE AND PROCESS FOR TREATING A MATERIAL WEB

CROSS-REFERENCE TO RELATED APPLICATIONS

The present application claims priority under 35 U.S.C. §119 of German Patent Application No. 298 11 048.2 filed Jun. 19, 1998, German Patent Application No. 198 16 673.7 filed Apr. 15, 1998, and German Patent Application No. 198 48 284.1 filed Oct. 20, 1998, the disclosures of which are expressly incorporated by reference herein in their entireties.

BACKGROUND OF THE INVENTION

Field of the Invention

The invention relates to a press device and process for treating a material web, in particular a paper or a cardboard web.

SUMMARY OF THE INVENTION

The present invention provides a compact press device which is as inexpensive as possible and which has a simple design. Further, the present invention provides a press device requiring low operating costs, which ensures an optimal web guidance and which also ensures, as much as possible, less rewetting of the material web and increased overall efficiency in treating a material web.

The present invention may be related to a calender roll system and provides increased efficiency and lower costs associated with treating a material web. The press device of the present invention includes two separate shoe presses positioned next to each other. The press device of the present invention further includes a transfer suction roll which is disposed between the two shoe presses. The material web, together with a felt, are continuously guided by the transfer suction roll, which is at least partially provided with suction, in a continuous manner. The material web is transported through at least one of the two shoe presses.

According to one embodiment of the invention, the distance between the nips of the two shoe presses may be relatively short. Further, it is possible to guide the web over a completely closed or a continuous, partially suctioned path. This may be particularly advantageous by requiring a low degree of rewetting of the material web, a lower decree of treating the web on both sides, and increased efficiency. The operating costs may be kept relatively low, particularly with respect to the felts, the drive, the vacuum production, the maintenance, and the like. The press device of the present invention is further distinguished by its reasonable manufacturing costs. For example, the vacuum requirement is considerably reduced because the large press suction roll required in the prior art, which included a thick jacket, is no longer necessary.

On the whole, the present invention results in the utilization of considerably lower drive power. Further, because a closed or continuous web guidance system is possible, the corresponding press section is particularly well suited for paper webs which have a low basis weight or which use high machine speeds. The number of felts is reduced to a minimum, which results in lower operating costs. The operating costs are further reduced by the lower vacuum requirement for suction devices as well as the lower drive power. The present invention also decreases initial investment costs, in that fewer guide rolls, regulators, clamps, suction devices, doctors, troughs, and the like are required. Further, a simpler, lever-free, and compact seating is also possible such that three cantilever carriers are sufficient.

According to the present invention, only one base felt is necessary so that there is more space available for certain subassemblies, such as the pulper. Also, the overall maintenance cost is considerably lower. The elimination of press roll mechanics tends to further minimize the initial investment costs. The lack of blade wear, maintenance and replacement decreases the operating costs as well as increases the availability of the machines to treat the material web. The lubricant spray tube may be eliminated. Further, the paper tension after the press section is decreased.

It is generally true that, if the number of the rolls and roll types used is reduced to a minimum, the number of rolls that have to be kept on hand is also correspondingly low, which in turn decreases the investment costs. Because the pick-up rolls, transfer rolls, and transfer suction rolls used in the invention may often be structurally identical, the number of rolls that must be kept on hand is reduced. Thus, the investment costs and maintenance costs can also be kept low.

The lengthy roll service lives also turn out to be advantageous. Thus, the use of a press suction roll is eliminated and hard covers are used practically exclusively. Moreover, because crowns are no longer required, an endless combination of line force regions with varying forces are possible. There is, for example, no line force dependency between the two nips.

Due to the compact embodiment, the space required for the relevant press section is minimal. For example, in a width of 5.5 m, approximately 10 m or less in the longitudinal direction of the press device is sufficient. The low spatial volume results in low investment costs both for the machine and the relevant building space that must be acquired or dedicated for this process.

Moreover, there is good accessibility. In a respective press jacket replacement, oil cannot get into the felt. In addition, the felt does not interfere with the jacket replacement. The relevant shoe press unit can be easily withdrawn for service work. To this end, for example, it is possible for there to be a travel-out carriage on a cantilever carrier. Removing the felt is not necessary for a respective withdrawal of the shoe press unit. The felt and roll replacement is embodied as extremely simple on the whole. One cantilevering per felt is sufficient. There is good accessibility to the rolls for a roll replacement via a crane. The form width can be varied with no trouble. Fundamentally, it is also possible for there to be a closed guidance (draw) of the web from the wire section to the end of the drying section.

Advantageously, the felt that is guided together with the material web over the transfer suction roll, may be routed through both shoe presses.

According to the present invention, each of the two shoe presses may be double felted.

According to another embodiment of the present invention, the press device as a whole may have a closed or continuous web guidance, which produces an increased efficiency and practically eliminates tears in the press device. A manual design is no longer required, which results in a correspondingly higher operational reliability and a high degree of machine availability. Due to the lack of open draws, it is practically impossible for paper stretching or web tearing to occur. In particular, the web does not have to be pulled away from smooth roll surfaces. Between the presses, the paper is no longer subjected to any fluctuations in tension. A corresponding tensile force coupling by way of a respective felt produces the desired synchronism. An ideal web guidance is always assured for both brown and white papers. This results in short rewetting segments and a good web securing between the presses.

In yet another embodiment of the present invention, the press device further includes a web holding box positioned after the transfer suction roll. More particularly, the web holding box may be placed between the suction roll and the subsequent shoe press.

According to one aspect of the invention, a pick-up felt is routed through at least the first shoe press which the material web encounters in the web travel direction.

Moreover, it is possible for one of the two shoe presses to be formed by a shoe press unit disposed on the bottom and a counter roll disposed on top. In one embodiment of the press device, both of the shoe presses are respectively formed by a shoe press unit disposed on the bottom and a counter roll disposed on top. The material web, together with a bottom felt which is routed through both the shoe presses, may be guided over the transfer suction roll.

For example, one of the two shoe presses can also be constituted by a shoe press unit disposed on top and a counter roll disposed on the bottom. In a suitable embodiment of the press device according to the invention, both of the shoe presses are respectively constituted by a shoe press unit disposed on top and a counter roll disposed on the bottom. In this instance, the material web is preferably guided over the transfer suction roll together with a top felt that is routed through both shoe presses.

In yet another aspect of the present invention, at least one shoe press unit is formed by a shoe press roll.

In an embodiment form that is particularly suited for liner with a white cover ("white top"), the shoe press that comes last in the web travel direction is single felted and the relevant counter roll may be touched or in contact with the material web.

The present invention is directed to a press device for treating a material web. The press device includes a first shoe press and a second shoe press. The first and the second shoe press are successively arranged in a web run direction. A transfer suction roll is positioned between the first shoe press and the second shoe press and is adapted to at least partially suction the material web and to guide the material web in a closed draw through at least one of the first and the second shoe presses.

According to another feature of the present invention, a transport felt is adapted for use with the transfer suction roll to guide the material web in the closed draw through the at least one of the first and the second shoe presses.

According to still another feature of the present invention, the material web may be composed of a paper web.

In accordance with still another feature of the present invention, the material web may be composed a cardboard web.

In a further feature of the present invention, a transport felt may be guided over the transfer suction roll and may be guided through the first shoe press and the second shoe press.

According to a still further feature of the present invention, the first and the second shoe presses are composed of double felted shoe presses.

In accordance with another feature of the present invention, the material web may be guided through the press device in a closed draw.

According to still another feature of the present invention, a web holding box may be located after the transfer suction roll relative to a web run direction and before the second shoe press.

In a further feature of the present invention, a felt may be guided through a first one of the first and the second shoe presses relative to a web run direction. The felt may be a pick-up felt.

In accordance with a still further feature of the present invention, at least one of the first and the second shoe presses may be composed of a shoe press unit and a counter roll. The shoe press unit may be positioned beneath the counter roll.

Further, each of the first and the second shoe presses may be composed of a shoe press unit and a counter roll. The shoe press units may be positioned beneath the counter rolls. The transfer suction roll may be positioned between the counter rolls and above a plane that extends through nips formed by the first and the second shoe presses. Further, the counter rolls may have a smooth surface. Further still, the counter rolls may have at least one of a grooved and blind bored surface. Still further, the shoe press units may be composed of shoe press rolls. The shoe press units may include press jackets, and the press jackets may have at least one of a grooved and blind bored surface. The counter rolls may be internally supported.

According to another feature of the present invention, a bottom felt may be guided through both of the first and the second shoe presses. The bottom felt may be adapted to guide the material web over the transfer suction roll.

In accordance with a further feature of the present invention, at least one of the first and the second shoe presses may be composed of a shoe press unit and a counter roll. The shoe press unit may be positioned on top of the counter roll. Further, each of the first and second shoe presses may be composed of a shoe press unit and a counter roll. The shoe press unit may be positioned on top of the counter roll. Further still, the transfer suction roll may be positioned between the counter rolls and below a plane that extends through nips formed by the first and the second shoe presses.

According to a still further feature of the present invention, a bottom felt may be guided through the first and the second shoe presses, and the bottom felt may be adapted to guide the material web over the transfer suction roll.

In accordance with yet another feature of the present invention, at least one of the first and the second shoe presses may be oriented obliquely to vertical at an angle up to approximately 30°.

According to stil another feature of the present invention, at least one of the first and the second shoe presses may be oriented vertically.

According to another feature of the present invention, a transport felt may be adapted to guide the material web through the first and the second shoe presses and around the transfer suction roll.

According to still another feature of the present invention, the transfer suction roll may include a plurality of suction zones successively arranged in a web run direction.

In accordance with a further feature of the present invention, a heating device may be positioned in a region of the transfer suction roll to act on a surface of the material web not in contact with the transfer suction roll.

The present invention may also be directed to a process for treating a material web in an apparatus that includes a first shoe press and a second shoe press, which are positioned adjacent each other, and a transfer suction roll positioned between the first shoe press and the second shoe press. The process may include at least partially suctioning the material web with the transfer suction roll, and guiding the material web in a closed draw through at least one of the first and the second shoe presses.

In accordance with another feature of the present invention, the apparatus may further include a transport felt, and the process further includes guiding the material web in the closed draw on the transport belt and through the at least one of the first and second shoe presses via the transport belt. Moreover, the process may include guiding the material web in the closed draw on the transport belt and through the first and the second shoe presses.

In a further feature of the present invention, the apparatus may further include a pick-up felt, and the process may further include pressing the material web between the pick-up felt and transport felt in a first one of the first and second shoe presses relative to a web run direction.

The process of the present invention may further include picking up the material web from a wire sieve with the transport belt.

According to still another feature of the present invention, the process may further include heating the web as it is guided over the transfer suction roll.

In accordance with a still further feature of the present invention, the transfer suction roll may include a plurality of suction zones successively arranged in the web run direction, and the process may further include suctioning the material web with at least one of the plurality of suction zones.

In accordance with yet another feature of the present invention, the process may further include guiding two press felts through the at least one of the first and the second shoe press, and pressing the material web between the two press felts in the at least one of the first and the second shoe presses.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
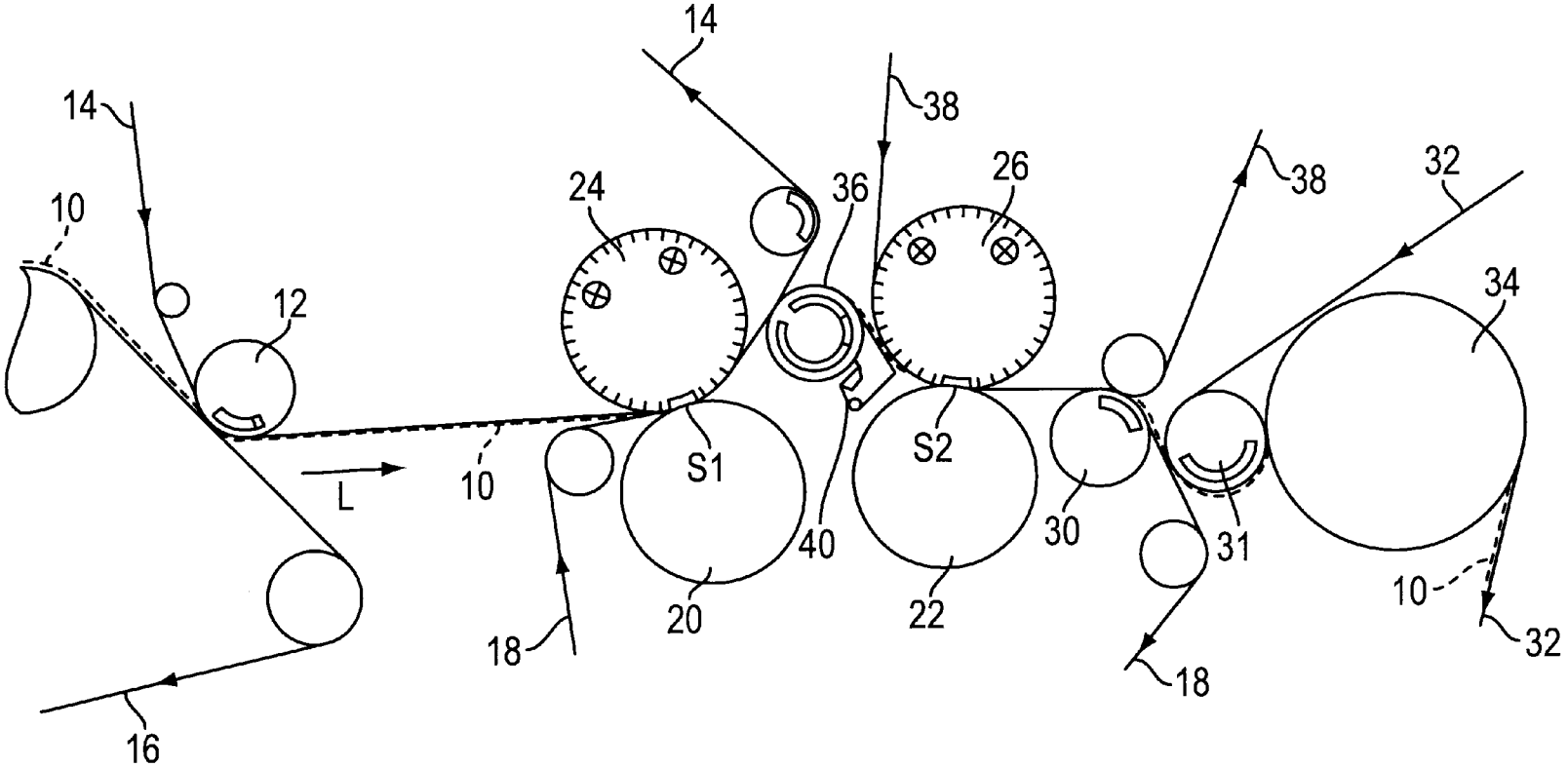
FIG. 1 schematically illustrates a partially sectional representation of an exemplary embodiment of a press device that has two shoe presses with shoe press units disposed on the bottom.

FIG. 1 is a partially sectional schematic representation of an exemplary embodiment of a press device of the present invention for treating a material web 10. The material web 10 can, for example, be a fibrous material web and, more particularly, may be paper or cardboard web.

The material web 10 is transferred from a wire sieve (screen) 16 to a top felt 14 by a suction roll 12. The material web 10 is then transported, together with a bottom felt 18, to a first nip S1. The first nip S1 is elongated in the web travel direction L. The material web 10, together with the bottom felt 18, then travel over a transfer suction roll 36 and after that, the material web 10 and bottom felt 18 are transported to a second nip S2. The second nip S2 is also elongated in the web travel direction L.

As seen in FIG. 1, the first and second nips S1 and S2, which are elongated in the web travel direction L, are formed by two separate, adjacent shoe presses. Each of the first and second nips Si and S2, include a shoe press unit 20 or 22, respectively, disposed on the bottom or below the material web 10 and a counter roll 24 or 26, respectively, disposed on top or above the material web 10. The shoe press units 20, 22, which may be formed as shoe press rolls, may each be disposed beneath the relevant counter roll 24 or 26 such that the distance between the axes of the shoe press units 20, 22 bottom is smaller than the distance between the axes of the counter rolls 24, 26.

The transfer suction roll 36 may be disposed between the counter rolls 24, 26, and may be placed above the plane that extends through the two nips S1 and S2.

As FIG. 1 also shows, the two shoe presses 20, 24 and 22, 26 may be disposed very close to each other so that there is a correspondingly short distance between the two nips S1 and S2 which are elongated in the web travel direction L.

After the second nip S2, the material web 10 may be guided over a deflection roll 30, which may be a suction roll. The material web 10 may also be guided around a second deflection roll 31, which may also be a suction roll. In any event, the material web 10 is transferred to the first drying cylinder 34 of a drying section by a drying belt or wire 32.

The material web 10 may be, for the most part, supplied with suction after the material web 10 and the bottom felt 18 are guided around the transfer suction roll 36 after the first nip S1. For the most part, the web is suctioned through the felt 18. Further, a continuously closed web guidance may be produced from the point at which the top felt 14, which is used as a pick-up felt, picks up the material web 10 from the wire sieve 16 to the point at which the material web 10 is transferred to the first drying cylinder 34 of the drying section.

Each of the two shoe presses 20, 24 and 22, 26, are double felted. For example, a top felt 38 and a bottom felt 18 are guided around the counter roll 26 of the second shoe press 22, 26, and a top felt 14 and a bottom felt 18 are guided around the counter roll 24 of the first shoe press. After the second elongated nip S2, the material web 10 may be separated again from the top felt 38 in the area of the deflection roll 30 that includes suction.

Figure 2:
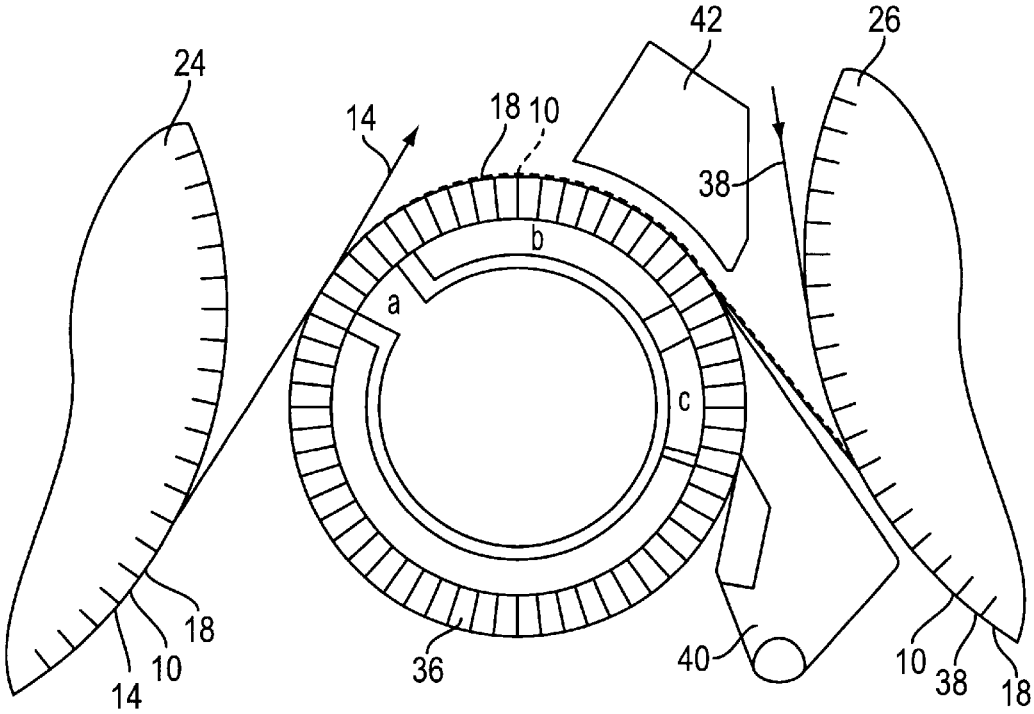
FIG. 2 is a schematic, enlarged representation of the transfer suction roll disposed between the two shoe presses that belongs to the press device according to FIG. 1.

As FIG. 2 shows, a web holding box 40 may be disposed after the transfer suction roll 36 and between the suction roll 36 and the counter roll 26 of the second shoe press 22, 26.

FIG. 2 also indicates that the transfer suction roll 36 may be divided into different suction regions a, b, and c.

In addition, it is possible to include at least one heating element 42, which can be, for example, a steam blow box or the like, disposed in the region of the transfer suction roll 36 that may be located somewhere in the region between the two shoe presses 20, 24 and 22, 25.

According to the exemplary embodiment of the invention, a press device may include two shoe press units 20 and 22 disposed on the bottom and two counter rolls 24 and 26 disposed on top or above the material web 10. Thus, material web 10, together with the bottom felt 18, may be guided over the transfer suction roll 36, which is routed through two shoe presses (20, 24 and 22, 26).

It is, for example, conceivable that a press device of this type may be produced by orienting the above-described press device as if rotated around the vertical and/or the horizontal axis. In the horizontally rotated variant, a top felt (pick-up felt) may be utilized such that both felts are guided through both nips.

Figure 3:
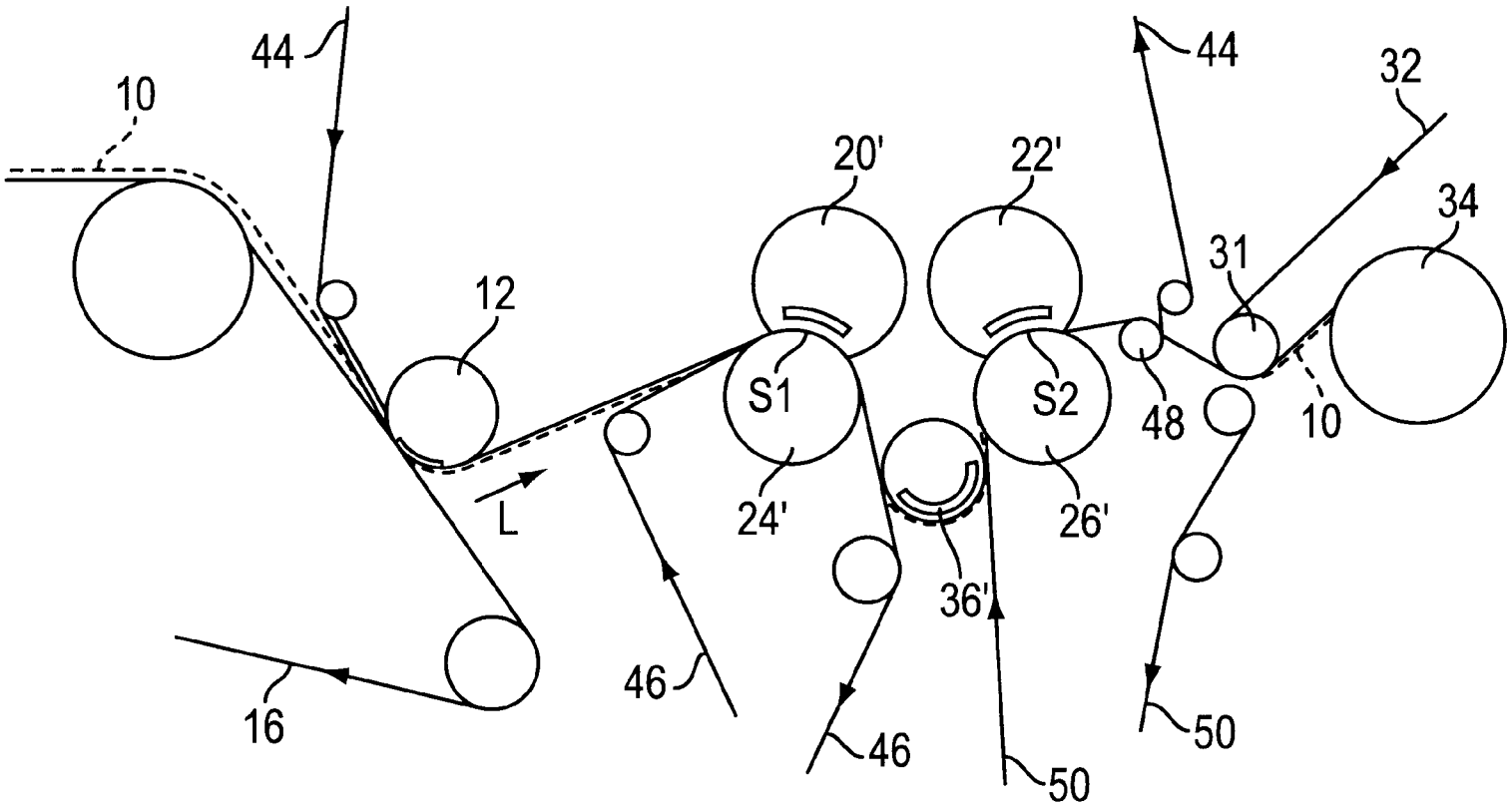
FIG. 3 is a schematic, partially sectional representation of an exemplary embodiment of a press device that has two shoe presses with shoe press units disposed on top.

FIG. 3 illustrates the device of the present invention whereupon the exemplary embodiment shown in FIG. 1 is oriented as if rotated approximately 180° around a horizontal axis.

In the embodiment shown in FIG. 3, the material web 10 is picked up from a wire sieve 16 by a top felt 44 in the area of a suction roll 12. The material web 10 is then guided via top felt 44 and bottom felt 46, to a first nip S1 which is elongated in the web travel direction L. The material web 10 and the top felt 44 then travel around a transfer suction roll 36'. After traveling around the suction roll 36', the material web is transported to the second nip S2 that is elongated in the web travel direction L.

As shown in FIG. 3, the two nips S1 and S2, which are elongated in the web travel direction L, are formed by two separate, adjacent shoe presses. The first and second nips S1 and S2 are formed by the respective shoe press unit 20' or 22' disposed on top and a counter roll 24' or 26' disposed on the bottom. The shoe press units 20', 22', which may be shoe press rolls, may each be disposed obliquely above the relevant counter roll 24' or 26'. Accordingly, the distance between the axes of shoe press units 20', 22' is smaller than the distance between the axes of counter rolls 24', 26'. The transfer suction roll 36' may be disposed between the counter rolls 24', 26' and below the plane that extends through the two nips S1 and S2.

As FIG. 3 also shows, the two shoe presses 20', 24' and 22', 26' may be disposed close to each other, so that there is a correspondingly short distance between the two nips S1 and S2, which are elongated in the web travel direction L.

After the second nip S2, which is elongated in the web travel direction L, the material web 10 may be guided over a deflection roll 48 and may be guided over another deflection roll 31, which may be a suction roll. The material web 10 is then picked up or transferred by a drying wire 32 and transported to the first drying cylinder 34 of a drying section.

After the material web 10, together with the top felt 44, are guided around the transfer suction roll 36' following the first elongated nip S1, the web may be, for the most part, supplied with suction. The suction is supplied primarily through the felt 44. Further, a continuously closed web guidance may be produced from the point at which the top felt 44, which is used as a pick-up felt, picks the material web 10 up from the wire belt 16 until the transfer to the drying section.

The bottom felt 46 is guided around the counter roll 24' of the first shoe press 20', 24' and a bottom felt 50 is guided around the counter roll 26' of the second shoe press 22', 26' so that the two shoe presses 20', 24' or 22', 26' are each double felted. After the second elongated nip S2, the material web 10 is separated again from the top felt 44 around the area of the deflection roll 48.

It is noted that the foregoing examples have been provided merely for the purpose of explanation and are in no way to be construed as limiting of the present invention. While the present invention has been described with reference to several embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE NUMERAL LIST

10 material web
12 suction roll
14 top felt
16 wire belt
18 bottom felt
20 bottom shoe press unit
22 bottom shoe press unit
24 top counter roll
26 top counter roll
20' top shoe press unit
22' top shoe press unit
24' bottom counter roll
26' bottom counter roll
30 deflection roll
31 deflection roll
32 drying screen
34 drying cylinder
36 transfer suction roll
36' transfer suction roll
38 top felt
40 web holding box
42 heating element
44 top felt
46 bottom felt
48 deflection roll
50 bottom felt
L web travel direction
S1 elongated nip
S2 elongated nip
a,b,c suction regions

What is claimed:

1. A press device for treating a material web, comprising:

a first shoe press and a second shoe press, said first and said second shoe press comprising double felted presses with felts arranged to sandwich the material web and being successively arranged in a web run direction;

a transfer suction roll positioned between said first shoe press and said second shoe press and structured and arranged to at least partially suction the material web and to guide the material web in a closed draw through at least one of said first and said second shoe presses;

a transport felt being guided through said first shoe press and said second shoe press, whereby said transport felt comprises one of the felts of said double felted presses, wherein said first shoe press comprises a shoe press roll and said second shoe press comprises a second shoe press roll and said first and said second shoe press rolls are positioned on a same side of the material web, and said transport belt is positioned on said same side of the material web as said first and second shoe press rolls.

2. The press device in accordance with claim 1, further comprising:

said transport felt structured and arranged for use with the transfer suction roll to guide the material web in the closed draw through said at least one of said first and said second shoe presses.

3. The press device according to claim 1, the material web being composed of a paper web.

4. The press device according to claim 1, the material web being composed a cardboard web.

5. The press device according to claim 1, wherein the transport felt is guided over the transfer suction roll.

6. The press device according to claim 1, wherein the transport felt forms a loop, and the suction transfer roll is located within the loop.

7. The press device according to claim 1, wherein the material web is guided through the press device in a closed draw.

8. The press device according to claim 1, further comprising:

a web holding box located after the transfer suction roll relative to a web run direction and before said second shoe press.

9. The press device according to claim 1, wherein one of the felts of the double felted presses is guided through a first one of said first and said second shoe presses relative to a web run direction, the one felt being a pick-up felt.

10. The press device according to claim 1, at least one of said first and said second shoe presses is composed of a shoe press unit and a counter roll, wherein said shoe press unit is positioned beneath the counter roll.

11. The press device according to claim 10, each of said first and said second shoe presses is composed of said respective shoe press roll and a counter roll, wherein each said shoe press roll is positioned beneath the counter rolls.

12. The press device according to claim 11, wherein said transfer suction roll is positioned between the counter rolls and above a plane that extends through nips formed by said first and said second shoe presses.

13. The press device according to claim 11, wherein the counter rolls have a smooth surface.

14. The press device according to claims 11, wherein the counter rolls have at least one of a grooved and blind bored surface.

15. The press device according to claim 11, wherein said shoe press units are composed of shoe press rolls.

16. The press device according to claim 11, said shoe press units comprising press jackets, wherein said press jackets have at least one of a grooved and blind bored surface.

17. The press device according to claim 11, wherein the counter rolls are internally supported.

18. The press device according to claim 10, wherein said transport felt is a bottom felt guided through both of said first and said second shoe presses, wherein said bottom felt is structured and arranged to guide the material web over the transfer suction roll.

19. The press device according to claim 10, at least one of the shoe press units being composed of a shoe press roll.

20. The press device according to claim 1, at least one of said first and said second shoe presses is composed of a shoe press unit and a counter roll, wherein said shoe press unit is positioned on top of the counter roll.

21. The press device according to claim 20, each of the first and second shoe presses is composed of said respective shoe press roll and a counter roll, wherein each said shoe press roll is positioned on top of the counter roll.

22. The press device according to claim 21, wherein the transfer suction roll is positioned between the counter rolls and below a plane that extends through nips formed by said first and said second shoe presses.

23. The press device according to claim 20, wherein said transport felt is a bottom felt guided through said first and said second shoe presses, wherein the bottom felt is structured and arranged to guide the material web over the transfer suction roll.

24. The press device according to claim 1, wherein the felts of the first double felted shoe press are separated from each other at said transfer suction roll.

25. The press device according to claim 1, at least one of said first and said second shoe presses being oriented obliquely to vertical at an angle up to approximately 30°.

26. The press device according to claim 1, at least one of said first and said second shoe presses being oriented vertically.

27. The press device according to claim 1, wherein said transport felt is structured and arranged to guide the material web through said first and said second shoe presses and around said transfer suction roll.

28. The press device according to claim 1, said transfer suction roll comprising a plurality of suction zones successively arranged in a web run direction.

29. The press device according to claim 1, further comprising a heating device positioned in a region of the transfer suction roll to act on a surface of the material web not in contact with the transfer suction roll.

30. A process for treating a material web in an apparatus that includes a first shoe press and a second shoe press, which are double felted presses with felts arranged to sandwich the material web that are positioned adjacent each other, a transfer suction roll positioned between the first shoe press and the second shoe press, and a transport felt guided through both the first and second press so that the transport belt forms one of the felts of the double felted presses, and the first shoe press includes a shoe press roll and the second shoe press includes a second shoe press roll and the first and said second shoe press rolls are positioned on a same side of the material web, the process comprising:

guiding the material web through the first and second presses via the transport felt, which is positioned on the same side of the material web as the first and second shoe presses;

at least partially suctioning the material web with the transfer suction roll, thereby transferring the material web from the first press to the second press; and guiding the material web in a closed draw through at least one of the first and the second shoe presses.

31. The process according to claim 30, further comprising separating the felts of the first double felted shoe press during the transfer of the material web to the second shoe press.

32. The process according to claim 30, wherein the process further comprises:

guiding the material web in the closed draw on the transport felt through the first and the second shoe presses.

33. The process according to claim 32, wherein the apparatus further includes a pick-up felt, and the process further comprises:

pressing the material web between the pick-up felt and transport felt in a first one of the first and second shoe presses relative to a web run direction.

34. The process according to claim 32, the process further comprising:

picking up the material web from a wire sieve with the transport belt.

35. The process according to claim 30, the process further comprising:

heating the web as it is guided over the transfer suction roll.

36. The process according to claim 30, wherein the transfer suction roll includes a plurality of suction zones successively arranged in the web run direction, and the process further comprises:

suctioning the material web with at least one of the plurality of suction zones.

* * * * *